US008708778B2

(12) United States Patent
Greenslet

(10) Patent No.: US 8,708,778 B2
(45) Date of Patent: Apr. 29, 2014

(54) FINISHING OF SURFACES OF TUBES

(75) Inventor: Hitomi Greenslet, Gainesville, FL (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 115 days.

(21) Appl. No.: 13/377,875

(22) PCT Filed: May 24, 2010

(86) PCT No.: PCT/US2010/035922
§ 371 (c)(1),
(2), (4) Date: Dec. 13, 2011

(87) PCT Pub. No.: WO2011/008346
PCT Pub. Date: Jan. 20, 2011

(65) Prior Publication Data

US 2012/0088440 A1 Apr. 12, 2012

Related U.S. Application Data

(60) Provisional application No. 61/225,297, filed on Jul. 14, 2009.

(51) Int. Cl.
*B24B 1/00* (2006.01)

(52) U.S. Cl.
CPC ..... *B24B 1/005* (2013.01)
USPC ..... 451/51; 451/103

(58) Field of Classification Search
CPC ..... B24B 1/005
USPC ..... 451/51, 103, 180
See application file for complete search history.

(56) References Cited

U.S. PATENT DOCUMENTS

| | | | | |
|---|---|---|---|---|
| 2,818,688 | A * | 1/1958 | Swedmark | 451/49 |
| 6,688,949 | B2 * | 2/2004 | Shinbo et al. | 451/51 |
| 7,537,610 | B2 * | 5/2009 | Reiss | 623/1.39 |
| 2002/0119738 | A1 * | 8/2002 | Shinbo et al. | 451/51 |
| 2003/0111338 | A1 * | 6/2003 | Lin et al. | 204/224 M |
| 2011/0301691 | A1 * | 12/2011 | Kamikihara et al. | 623/1.15 |

FOREIGN PATENT DOCUMENTS

| | | | |
|---|---|---|---|
| JP | 63-050653 | U | 4/1988 |
| JP | 2006-247754 | A | 9/2006 |
| WO | 0128701 | A | 4/2001 |

OTHER PUBLICATIONS

Yamaguchi, H., J. Kang, Study of Internal Deburring of Capillary Tubes with Multiple Laser-machined Slits, Apr. 2-3, 2009, pp. 1-17, University of Florida, Department of Mechanical and Aerospace Engineering, Gainesville, FL.

The International Search Report and Written Opinion dated Aug. 27, 2010.

Yamaguchi, et al., "Study of Internal Finishing of Austenitic Stainless Steel Capillary Tubes by Magnetic Abrasive Finishing," Journal of Manufacturing Science and Engineering, Oct. 2007, vol. 129, pp. 885-892.

* cited by examiner

*Primary Examiner* — Maurina Rachuba
(74) *Attorney, Agent, or Firm* — Thomas|Horstemeyer, LLP

(57) ABSTRACT

The present disclosure involves various embodiments for finishing the internal wall of a capillary tube. A quantity of abrasive particles and a rod are placed in a capillary tube, wherein a portion of the abrasive particles is magnetic. A magnet is positioned near a side of the capillary tube, thereby attracting the abrasive particles toward an internal wall of the capillary tube. A relative rotation of the capillary tube is produced with respect to the magnet, thereby causing the abrasive particles to finish the internal wall of the capillary tube.

30 Claims, 3 Drawing Sheets

FINISHING OF SURFACES OF TUBES

CROSS REFERENCE TO RELATED APPLICATION

This application is the 35 U.S.C. §371 national stage of, and claims priority to, PCT application entitled "Finishing of Surfaces of Tubes," having serial number PCT/US2010/35922, filed on May 24, 2010 which claims priority to and benefit of U.S. Provisional Application No. 61/225,297, filed on Jul. 14, 2009, both of which are incorporated by reference in their entirety.

BACKGROUND

Capillary tubes are employed in various medical devices such as stents, catheters, and the like. The process of manufacturing capillary tubes can create imperfections that may project inward from an internal wall of a capillary tube. Such imperfections can reduce the internal cross sectional area of the capillary tube and ultimately impede the flow of fluids through such capillary tubes.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

Figure 1:
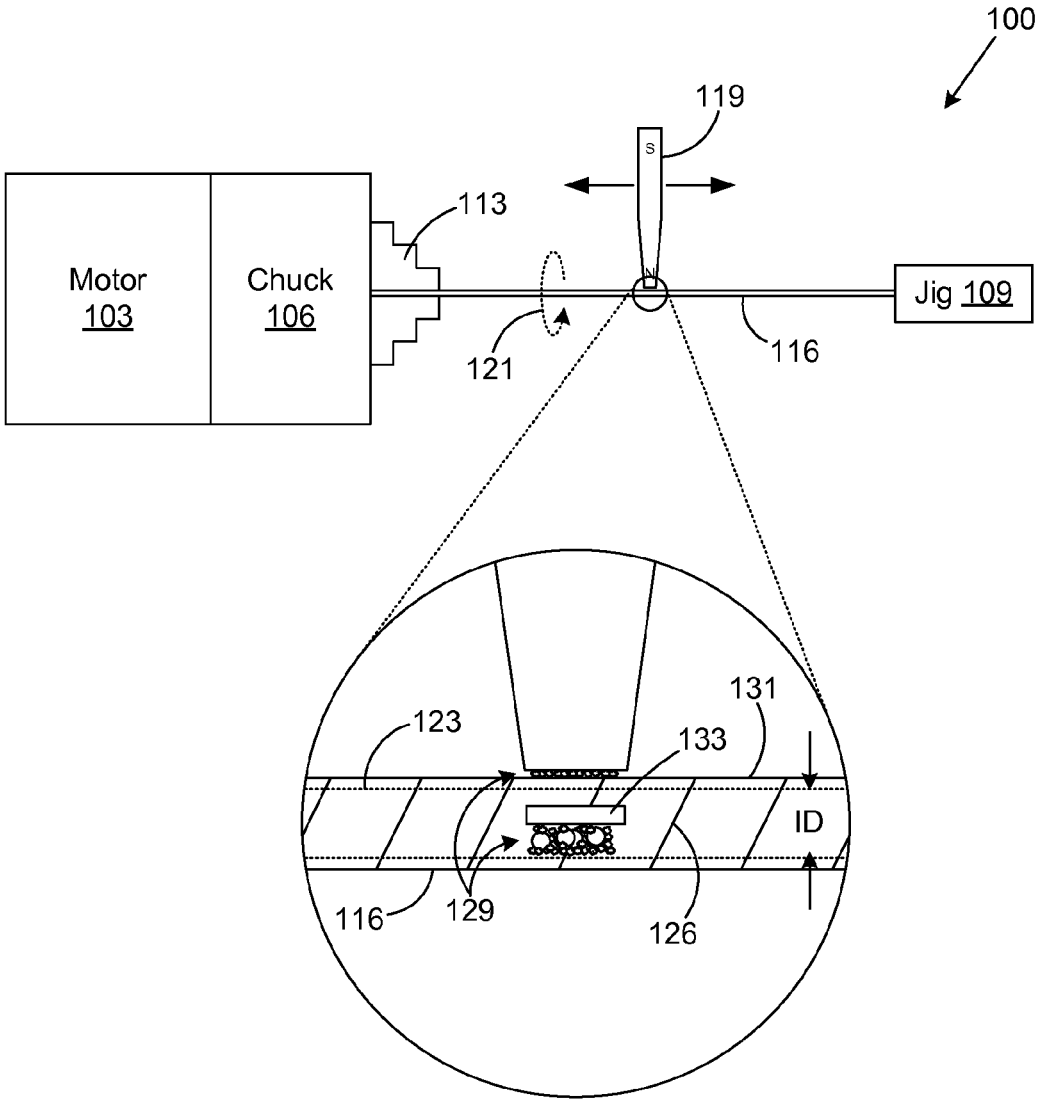
FIG. 1 is a drawing of an apparatus for finishing an interior of a capillary tube according to an embodiment of the present disclosure.

With reference to FIG. 1, shown is a capillary tube finishing system 100 according to various embodiments. The capillary tube finishing system 100 includes a motor 103, a chuck 106, and a jig 109. The chuck 106 includes jaws 113 that are configured to clamp onto a capillary tube 116. A magnet 119 is positioned near a side of the capillary tube 116.

The capillary tube 116 may be manufactured to be used as a stent, with a catheter, and for other potential uses in the medical field and in other fields. As defined herein, a capillary tube 116 is a tube that promotes fluid flow therethrough by way of capillary action promoted by surface tension between the fluid and the inner wall of the capillary tube 116. Thus, a capillary tube 116 is relatively small, having an inner diameter that may be less than or equal to, for example, 500 μm, although it is possible that the inner diameter may be greater than 500 μm and still facilitate capillary action. While the approaches for finishing the internal walls 123 of a capillary tube 116 are applied to capillary tubes 116 having inner diameters of 500 μm or less, it is understood that the same principles may apply to capillary tubes 116 or other types of tubes having an inner diameter that is greater than 500 μm to which the principles described herein apply.

When the capillary tubes 116 are initially manufactured, they may include various imperfections in the internal wall 123. According to various embodiments, such imperfections are removed during a finishing process in which magnetic force is employed to cause an abrasive comprising a plurality of abrasive particles 129 within the capillary tube 116 to scrape the internal wall 123 of the capillary tube 116 to remove such imperfections as will be described. In addition, some abrasive particles 129 may be disposed outside the capillary tube 116 and are held against the magnet 119 by way of magnetic attraction. Where the magnet 119 is disposed close enough to the capillary tube 116, such abrasive particles 129 can come into contact with an exterior wall 131 of the capillary tube 116 and may polish the exterior wall 131 of the capillary tube 116.

In some situations, the capillary tube 116 may include various slits 126 cut into the internal wall 123 of the capillary tube 116, thereby imparting a degree of flexibility to the capillary tube 116. In one embodiment, the slit 126 comprises a spiral shape that winds along the length of the capillary tube 116. Such slits 126 may be created by using a laser to cut through the wall of the capillary tube 116. In the case that a capillary tube 116 is used for the flow of fluids as may be the case with the use of a capillary tube 116 as a needle or a stent, the width of the slits 126 is specified so that the fluid is still maintained within the capillary tube 116. To this end, if the viscosity of the fluid is great enough, then it will not leak out of the slits 126 created in the side of the capillary tube 116.

In the case of a spiral slit 126 as shown, a significant degree of flexibility is imparted to the capillary tube 116 allowing it to bend around curves and structures as can be appreciated. In order to make the slit 126 in the side of a capillary tube 116, according to one approach, a laser is used to cut through the side of the capillary tube 116. As a result of the laser cutting process, relatively large burrs may be created on either side of the slit 126 on the internal wall 123 of the capillary tube 116. The height of such burrs may approach up to 90 μm and greater as can be appreciated. Such burrs may comprise lumps of metal that are fused to the internal wall 123 of the capillary tube 116 by virtue of the fact that a laser melts the metal of the capillary tube 116 to form the slits 126. The laser used to cut the slit 126 may be, for example, a neodymium: yttrium-aluminum-garnet (Nd-YAG) solid state laser or a Femto second laser as can be appreciated.

The burrs that are created on the internal wall 123 of the capillary tube 116 as a result of cutting a slit 126 by using a laser are typically much larger than the imperfections that normally occur in the internal wall 123 of a capillary tube 116 without slits 126. As described herein, various approaches are employed to remove such burrs from the internal walls 123 of the capillary tube 116. In one embodiment, the abrasive particles 129 are disposed within the capillary tube 116. At least a portion of the abrasive particles 129 are magnetic so as to be attracted to the magnet 119. According to one embodiment, the abrasive particles 129 are made up of various sizes as will be described. Such abrasive particles 129 may be magnetic and/or nonmagnetic and are made of various materials as will be described. In addition, a rod 133 is disposed in the capillary tube 116 to aid in finishing the internal wall 123 of the capillary tube 116.

Next, the general process for finishing the internal wall 123 of a capillary tube 116 using the abrasive particles 129 is described. To begin, the abrasive particles 129 and the rod 133 are placed inside the capillary tube 116. The capillary tube 116 is mounted in the jaws 113 of the chuck 106 and in the jig 109. The magnet 119 is positioned near the side of the capillary tube 116 such that it attracts the magnetic abrasive particles 129 included in the abrasive particles 129. In addition, the nonmagnetic abrasive particles 129 are pushed toward the internal wall 123 of the capillary tube 116 by the magnetic force that is exerted to the magnetic abrasive particles 129. To this end, the nonmagnetic abrasive particles 129 may be entrapped within the group of abrasive particles 129 and move along with the magnetic abrasive particles 129 that are subject to the magnetic force applied by the magnet 119. At the same time, the magnet 119 and the capillary tube 116 are placed in relative rotation 121 with respect to each other. In one embodiment, the motor 103 causes the chuck 106 to spin, thereby spinning the capillary tube 116 about its longitudinal axis relative to the magnet 119. The magnet 119 may be stationary or may rotate or orbit around the capillary tube 116 at a velocity and/or direction that is different than the rotation of the capillary tube 116, thereby resulting in a net relative rotation 121 of the capillary tube 116 with respect to the magnet 119. Alternatively, the capillary tube 116 may be held stationary and the magnet 119 may be rotated about the capillary tube 116. As the relative rotation 121 of the capillary tube 116 with respect to the magnet 119 occurs, the abrasive particles 129 scrape the internal wall 123 of the capillary tube 116 and remove all burrs and other imperfections from the internal wall 123 of the capillary tube 116. The rod 133 is attracted toward the magnet 119 as well, thereby exerting a force against the abrasive particles 129, further pushing them against the internal wall 123 of the capillary tube 116.

In situations where slits 126 are cut in the sides of the capillary tube 116, then any rotation of the capillary tube 116 is performed in such a manner so as to maintain the slits 126 in a closed state. For example, if a spiral slit 126 is cut into a side of a capillary tube 116 as was described above, the capillary tube 116 may be spun in a direction that causes the spiral slit 126 to close rather than to open. Alternatively, where slits 126 are cut into the sides of the capillary tube 116 in other configurations, it may be the case that the direction in which the capillary tube 116 is spun may cause such slits 126 to open or close. Alternatively, the speed at which the capillary tube 116 is spun may further determine whether the slits 126 open or close. To this end, according to one embodiment, the capillary tube 116 is spun in such a manner that the slits 126 are maintained in as closed as possible so as to prevent the abrasive particles 129 from exiting the inside of the capillary tube 116. To this end, the speed and direction of the spinning of the capillary tube 116 may be adjusted as is appropriate in a case-by-case basis. Alternatively, the capillary tube 116 may be held stationary and the magnet 119 may be rotated around the capillary tube 116, thereby maintaining the slits 126 in a closed state.

In addition, the abrasive particles 129 may escape the inside of the capillary tube 116 through the slit 126 and adhere to the magnet 119. Alternatively, such abrasive particles 129 may be placed between the magnet 119 and the exterior wall 131 manually. Such particles may provide for the finishing of the exterior wall 131 of the capillary tube 116 when they come into contact with the exterior wall 131 during the relative rotation 121 between the capillary tube 116 and the magnet 119.

Figure 2:
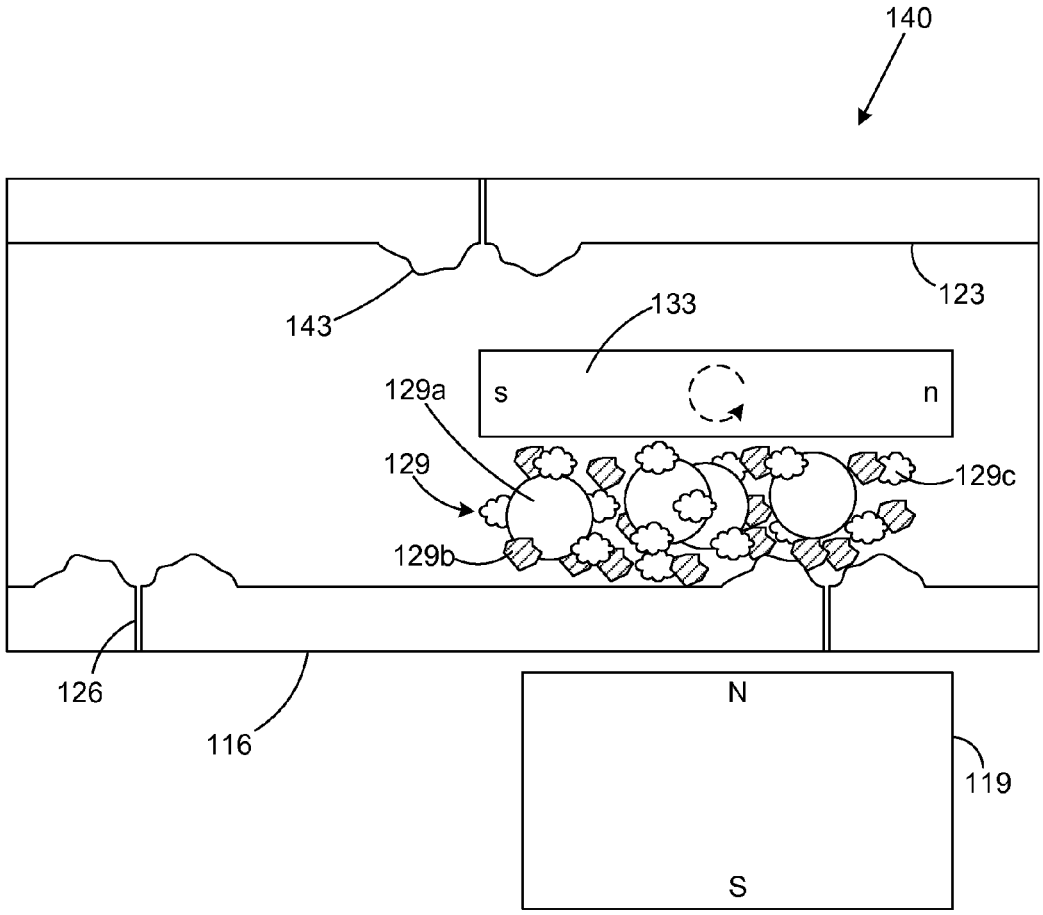
FIG. 2 is a cutaway view of a portion of the capillary tube of FIG. 1 according to an embodiment of the present disclosure.

Referring next to FIG. 2, shown is a cutaway view of a portion of a capillary tube 116 that depicts an arrangement 140 for finishing the internal walls 123 of the capillary tube 116 according to various embodiments. As shown, the abrasive particles 129 include, for example, iron particles 129*a*, diamond abrasive particles 129*b*, and magnetic abrasive particles 129*c*. While the relative rotation 121 (FIG. 1) between the capillary tube 116 and the magnet 119 is established, the magnetic abrasive particles 129*c* tend to hold or entrap the diamond abrasive particles 129*b* in the proper position against the internal wall 123 to aid in the finishing of the internal wall 123 of the capillary tube 116. The magnetic abrasive particles 129*c* may comprise, for example, composite particles including iron particles and $Al_2O_3$ abrasive grains. These particles are obtained from a composite ingot that is made by way of a thermite process using aluminum powder and iron oxide powder. The ingot is then mechanically crushed and processed through a sieve to obtain the magnetic abrasive particles 129*c*. The $Al_2O_3$ grains may be located both inside and outside the resulting magnetic abrasive particles 129*c*. The magnetic abrasive particles 129*c* in practical use have an average diameter of 80 μm, and the contained $Al_2O_3$ abrasive grains are smaller than 10 μm.

The rod 133 is constructed of a ferrous material such as cold-worked 304 stainless steel or other appropriate material. Such material exhibits ferromagnetism with magnetic anisotropy due to the transformation of the crystal structure of the material. In the case of cold-worked 304 stainless steel, for example, such crystal structure results from the transformation from austenite to martensite. An annealing process can be applied to the rod 133 to reverse the transformation back to the austenitic structure.

Given that the rod 133 exhibits ferromagnetism, it is attracted to the magnet 119 that is positioned near the side of the capillary tube 116. Also, given that the rod 133 is magnetically anisotropic, the magnet 119 is prevented from inducing a magnetic polarization on the rod 133 that would be orthogonal to the axial direction of the rod 133. To this end, given that the rod 133 is magnetically anisotropic, the north and south poles are established at respective ends of the rod 133 as shown.

When the magnet 119 is positioned near the side of the capillary tube 116 near the abrasive particles 129 and the rod 133, the iron particles 129*a*, the magnetic abrasive particles 129*c*, and the rod 133 are then positioned within the magnetic field of the magnet 119 and are attracted toward the magnet 119, thereby pulling the abrasive particles 129 against the internal wall 123 of the capillary tube 116. The magnetic abrasive particles 129*c* effectively hold the diamond abrasive particles 129*b* against the interior wall 123 of the capillary tube 116. According to one embodiment, the magnetic abrasive particles 129*c* are a composite of iron and aluminum oxide. The magnetic abrasive particles 129*c* may have a mean diameter of approximately 80 μm, for example, although portions of the magnetic abrasive particles 129 comprising aluminum oxide may be less than 10 μm in diameter or other size. Although the aluminum oxide grain may not be large enough to remove solidified material from the internal wall 123, the irregularity of the shape and size of the magnetic abrasive particles 129*c* serve to hold the diamond abrasive particles 129*b* between the magnetic abrasive particles 129*c* and the internal wall 123 of the capillary tube 116. It is understood that there may be many other different types of particles that may be substituted for the magnetic abrasive particles 129*c* described herein.

According to one embodiment, the diamond abrasive particles 129*b* work along with the magnetic abrasive particles 129*c* to help remove unwanted material such as burrs 143 from the internal wall 123. The rod 133 increases the magnetic force that acts on the ferrous particles 129*a* and 129*c*, thereby effectively pushing the diamond abrasive particles 129*b* against the inner wall 123 of the capillary tube 116. The combination of the iron particles 129*a*, diamond abrasive particles 129*b*, and magnetic abrasive particles 129*c* enhances the processing efficiency in order to finish the internal wall 123 of the capillary tube 116.

By establishing the relative rotation 121 between the capillary tube 116 and the magnet 119 while the magnet 119 is positioned near the side of the capillary tube 116, the abrasive particles 129 scrape the internal wall 123 of the capillary tube 116 and ultimately leave a finished surface on the internal wall 123. As a consequence, the full inner diameter ID of the capillary tube 116 is available for fluid flow and other purposes as can be appreciated. Also, burrs 143 and other imperfections are prevented from dislodging from the internal wall 123 and floating away, thereby potentially causing harm within a human or other body when the capillary tube 116 is used in a medical application or potentially causing harm in other applications.

Advantageously, given that the rod 133 is attracted to magnet 119 by virtue of being placed within the magnetic field of the magnet 119, the rod 133 is forced toward the internal wall 123 of the capillary tube 116 as the relative rotation 121 of the capillary tube 116 with respect to the magnet 119 occurs. The abrasive particles 129 are positioned between the rod 133 and the internal wall 123 of the capillary tube 116. As such, the rod 133 may press at least a portion of the abrasive particles 129 against the internal wall 123 of the capillary tube 116. Given that the rod 133 includes a north pole and south pole on its respective ends, it may be that one side of the rod 133 is attracted to the internal wall 123 of the capillary tube 116 with greater force than the opposite side.

For example, where a north pole of the magnet 119 is closest to a side of the capillary tube 116, then the end of a rod 133 at which the south pole is located is more likely to be attracted toward the internal wall 123 than the side of the rod 133 at which a north pole is located. To this end, the rod 133 may attempt to rotate in order to "stand up" within the capillary tube 116 as shown. In order to minimize the possibility that a rod 133 can significantly stand up within the capillary tube 116, the length of the rod 133 may be specified so that the side of the rod 133 that moves away from the magnet 119 is contained by the opposite internal wall 123 of the capillary tube 116 such that a slant of the rod 133 relative to the capillary tube 116 is minimal. As such, the benefit of pressing the magnetic particles 129 against the internal wall 123 is maintained as described above.

In order to finish the entire internal wall 123 of the capillary tube 116, the magnet 119 is moved along the axial direction of the capillary tube 116. Given that the abrasive particles 129 and the rod 133 are attracted to the magnet 119, they follow the movement of the magnet 119. Also, the nonmagnetic abrasive particles 129 tend to move with the magnetic abrasive particles 129. This allows the entire internal wall 123 of the capillary tube 116 to be finished.

Figure 3:
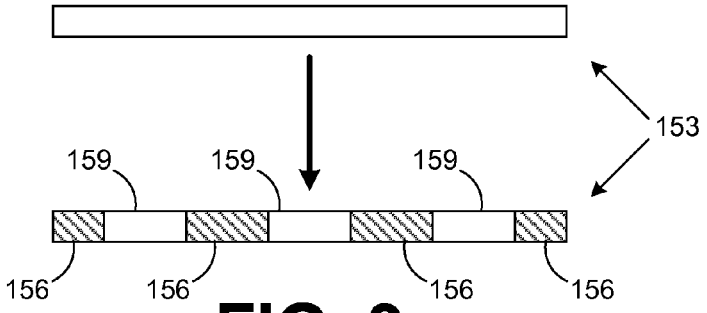
FIG. 3 is a drawing of a rod that is employed in the finishing of the capillary tube of FIG. 1 according to an embodiment of the present disclosure.

With reference next to FIG. 3, shown is an example of a rod 153 that has undergone a selective annealing process, thereby resulting in both nonferrous sections 156 and magnetically anisotropic sections 159. To this end, the rod 153 starts out as fully magnetically anisotropic. Sections of the rod 153 are subjected to an annealing process, thereby resulting in several nonferrous sections 156 between or adjacent to the remaining magnetically anisotropic sections 159. Each of the magnetically anisotropic sections 159 includes its own north and south pole similar to the rod 133 described with respect to FIG. 2. According to one embodiment, the nonferrous sections 156 and the magnetically anisotropic sections 159 are alternatively arranged along a length of the rod 153.

Figure 4:
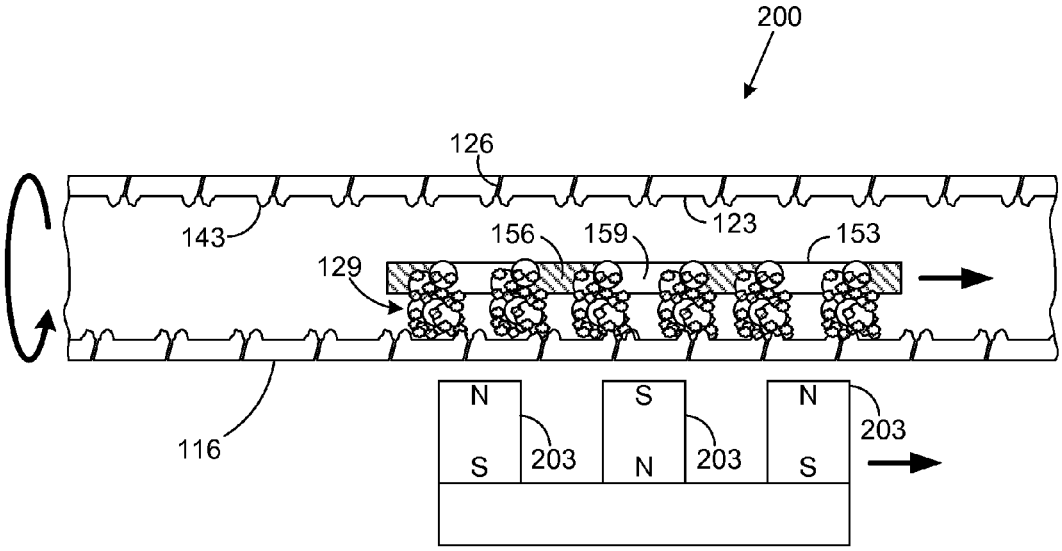
FIG. 4 is a cutaway view of a portion of another capillary tube of FIG. 1 according to an embodiment of the present disclosure.

With reference then to FIG. 4, shown is an arrangement 200 for finishing of an internal wall 123 of a capillary tube 116 that employs the rod 153 with alternatively arranged nonferrous sections 156 and magnetically anisotropic sections 159 as discussed above. To this end, the internal wall 123 includes the burrs 143 created by the cutting of a spiral slit 126 as described above. The arrangement 200 further includes a plurality of magnets 203 that are positioned relative to each other in intervals that coincide with locations of the magnetically anisotropic sections 159 of the rod 153. The polarity of each magnet 203 is specified in an alternating arrangement where adjacent magnets 203 are oriented in an opposite manner.

The arrangement 200 provides for the finishing of the internal wall 123 of the capillary tube 116 by virtue of the fact that the magnetic abrasive particles 129 are attracted to the magnetically anisotropic sections 159 of the rod 153. The magnetic force exerted upon the rod 153 by virtue of the magnetic field generated by the magnets 203 causes the rod 153 and the abrasive particles 129 to push against the internal wall 123 of the capillary tube 116 in a manner similar to that described above.

However, given that multiple magnetically anisotropic sections 159 exist within the rod 153, the rod 153 is much less likely to attempt to stand up as described above. As a consequence, the rod 153 exerts a more evenly distributed force against the abrasive particles 129 to provide for more effective finishing of the internal wall 123 of the capillary tube 116.

As shown in FIG. 4, the abrasive particles 129 tend to cluster around the junctions between the nonferrous sections 156 and the magnetically anisotropic sections 159. When the relative rotation of the capillary tube 116 with respect to the magnets 203 occurs and the magnets 203 are moved in the axial direction along the side of the capillary tube 116, the abrasive particles 129 and the rod 153 follow the motion of the magnets 203 and exhibit the appropriate relative motion against the internal wall 123 of the capillary tube 116 causing removal of the burrs 143. This results in effective deburring and finishing in multiple processing areas as shown. According to one embodiment, each of the magnets 203 is aligned with a respective one of the magnetically anisotropic sections 159 of the rod 153.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. An arrangement, comprising:

a capillary tube configured to promote a flow of a fluid by a surface tension between the fluid and the capillary tube;

at least one magnet positioned near a side of the capillary tube;

a plurality of abrasive particles disposed in the capillary tube within a magnetic field of the at least one magnet, wherein at least a portion of the abrasive particles is magnetic; and a rod disposed in the capillary tube.

2. The arrangement of claim 1, wherein the rod is disposed within the magnetic field of the at least one magnet.

3. The arrangement of claim 1, wherein a plurality of additional abrasive particles is disposed between an outer wall of the capillary tube and the magnet.

4. The arrangement of claim 1, wherein the capillary tube is mounted in an apparatus configured to establish a rotation of the capillary tube relative to the magnet.

5. The arrangement of claim 4, wherein the magnet is rotated about the capillary tube.

6. The arrangement of claim 4, wherein the capillary tube is rotated about a longitudinal axis of the capillary tube.

7. The arrangement of claim 6, wherein the magnet is stationary.

8. The arrangement of claim 1, wherein the abrasive particles are positioned between the rod and an internal wall of the capillary tube.

9. The arrangement of claim 1, wherein at least some of the abrasive particles are ferromagnetic.

10. The arrangement of claim 1, wherein at least some of the abrasive particles are diamond particles.

11. The arrangement of claim 1, wherein the rod presses at least a portion of the abrasive particles against an internal wall of the capillary tube.

12. The arrangement of claim 1, wherein the rod is magnetically anisotropic.

13. The arrangement of claim 1, wherein the rod comprises at least one magnetically anisotropic section.

14. The arrangement of claim 13, wherein the rod further comprises at least one nonferromagnetic section.

15. The arrangement of claim 1, wherein the rod comprises a plurality of magnetically anisotropic sections and a plurality of nonferromagnetic sections alternatively arranged along a length of the rod.

16. The arrangement of claim 1, wherein at least one slit is disposed in a side of the capillary tube.

17. The arrangement of claim 16, wherein the at least one slit further comprises a spiral slit.

18. The arrangement of claim 4, wherein a spiral slit is disposed in at least a portion of the side of the capillary tube.

19. The arrangement of claim 1, wherein the at least one magnet further comprises a plurality of magnets.

20. The arrangement of claim 19, wherein:

the rod comprises a plurality of magnetically anisotropic sections and a plurality of nonferromagnetic sections alternatively arranged along a length of the rod; and each of the magnets is aligned with a respective one of the magnetically anisotropic sections of the rod.

21. The arrangement of claim 20, wherein the rod follows a movement of the magnets in an axial direction of the capillary tube.

22. A method, comprising the steps of:

placing a quantity of abrasive particles and a rod in a capillary tube, wherein a portion of the abrasive particles is magnetic, wherein the capillary tube is configured to promote a flow of a fluid by a surface tension between the fluid and the capillary tube;

positioning a magnet near a side of the capillary tube, thereby attracting the abrasive particles toward an internal wall of the capillary tube; and producing a relative rotation of the capillary tube with respect to the magnet, thereby causing the abrasive particles to finish the internal wall of the capillary tube.

23. The method of claim 22, further comprising the step of moving the magnet along the side of tube, where the abrasive particles move along with the magnet inside the tube.

24. The method of claim 22, further comprising the step of positioning at least a portion of the abrasive particles between the rod and the internal wall of the capillary tube.

25. The method of claim 24, wherein at least a portion of the rod is magnetic and is attracted toward the internal wall of the capillary tube due to the positioning of the at least one magnet, the method further comprising the step of pressing the abrasive particles against the internal wall of the capillary tube using the rod.

26. The method of claim 22, wherein a spiral slit is disposed in a side of the capillary tube, and the capillary tube is rotated in a direction that causes a closing of the slit.

27. The method of claim 22, wherein the rod is magnetically anisotropic.

28. The method of claim 22, wherein the rod comprises at least one magnetically anisotropic section and at least one nonferromagnetic section.

29. The method of claim 28, wherein at least a portion of the abrasive particles cluster near a junction of one of the magnetically anisotropic sections and one of the nonferromagnetic sections.

30. The arrangement of claim 1, wherein an inner diameter of the capillary tube is less than or equal to about 500 μm.

* * * * *